United States Patent [19]

Röeder et al.

[11] 4,295,820

[45] Oct. 20, 1981

[54] GAS BLENDING FLAME CUTTER

[75] Inventors: Georg Röeder; Helmut Sachs, both of Frankfurt am Main, Fed. Rep. of Germany

[73] Assignee: Messer Griesheim GmbH, Frankfurt am Main, Fed. Rep. of Germany

[21] Appl. No.: 25,287

[22] Filed: Mar. 29, 1979

[30] Foreign Application Priority Data

Apr. 29, 1978 [DE] Fed. Rep. of Germany ..... 2819132

[51] Int. Cl.[3] ..... H01M 6/18; F23Q 7/06

[52] U.S. Cl. ..... 431/191; 431/263; 431/264

[58] Field of Search ..... 431/263, 264, 191, 255

[56] References Cited

U.S. PATENT DOCUMENTS

| | | | |
|---|---|---|---|
| 3,220,459 | 11/1965 | Wilson | 431/255 |
| 3,255,803 | 6/1966 | Hach, Jr. et al. | 431/255 X |
| 3,280,881 | 10/1966 | Hach, Jr. et al. | 431/255 |
| 4,035,136 | 7/1977 | Howatt et al. | 431/191 |
| 4,121,419 | 10/1978 | Kuznetson et al. | 431/264 X |

FOREIGN PATENT DOCUMENTS

| | | | |
|---|---|---|---|
| 1113038 | 11/1954 | France | 431/263 |

*Primary Examiner*—Samuel Scott
*Assistant Examiner*—Randall L. Green
*Attorney, Agent, or Firm*—Connolly and Hutz

[57] ABSTRACT

An ignition device for igniting flame cutters is directly connected with one of the passages for the fuel gas mixture to thereby assure a constantly certain ignition.

8 Claims, 2 Drawing Figures

GAS BLENDING FLAME CUTTER

BACKGROUND OF INVENTION

The present invention is concerned with a gas blending flame cutter consisting of a torch head in which the cutting nozzle is inserted gas tight by means of an adjusting screw as well as of a device associated with the torch for the purpose of igniting the heat flames.

According to a known flame cutter of the above-mentioned type (U.S. Pat. No. 3,255,803), an ignition arrangement is provided inside the cutting oxygen passage. At the end nearest the outlet of this passage, a transverse bore is located which is connected with the passage for the gas mixture. Part of the gas mixture reaches the cutting oxygen passage and is ignited there by means of the ignition device. The resulting igniting flame bursts out of the central cutting oxygen passage of the nozzle and thereby ignites the heating gas streaming out of the gas blend passage so that, in this way, the heating flames are formed.

It is further known that, with a manual autogenic flame cutter, (U.S. Pat. No. 3,220,459), one can provide a separate ignition chamber, near the torch head, in which a fuel gas-air mixture is ignited. The thereby resulting ignition flame comes out of a separate opening provided on the torch head in the immediate vicinity of the cutting nozzle orifice. By means of this separate igniting flame, the gas mixture streaming out of the cutting nozzle is ignited to form the heating flames.

SUMMARY OF INVENTION

It is the object of the present invention, proceeding from the previously described state of the art, to provide an ignition device for a flame cutter which is kept simple in construction but which, in spite of this, has optimal ignition properties by means of which a continuously trouble-free ignition of the flame cutter is assured.

In order to solve the mentioned object, it is proposed according to the invention, that the ignition device be connected with one of the blend passages in the cutting nozzle.

According to the preferred embodiment of the invention, it is hereby provided that the ignition device is installed in the torch head and is connected with the blend passage via at least one ignition bore.

According to the preferred embodiment of the invention, it is further provided that the blend passage has an expansion space which discharge(s) into the ignition bore(s).

As a result of the inventive design of the ignition device, a direct ignition of the gas mixture is advantageously achieved in one of the blend passages. The thereby resulting igniting flame strikes forward in this passage all the way through to the tip of the nozzle and ignites the exiting individual gas jets which flow out of the other blend passages which surround the cutting oxygen passage.

THE DRAWINGS

FIG. 1 is a cross-sectional view of a flame cutter in accordance with this invention; and FIG. 2 is an end view thereof.

DETAILED DESCRIPTION

Figures 1, 2:
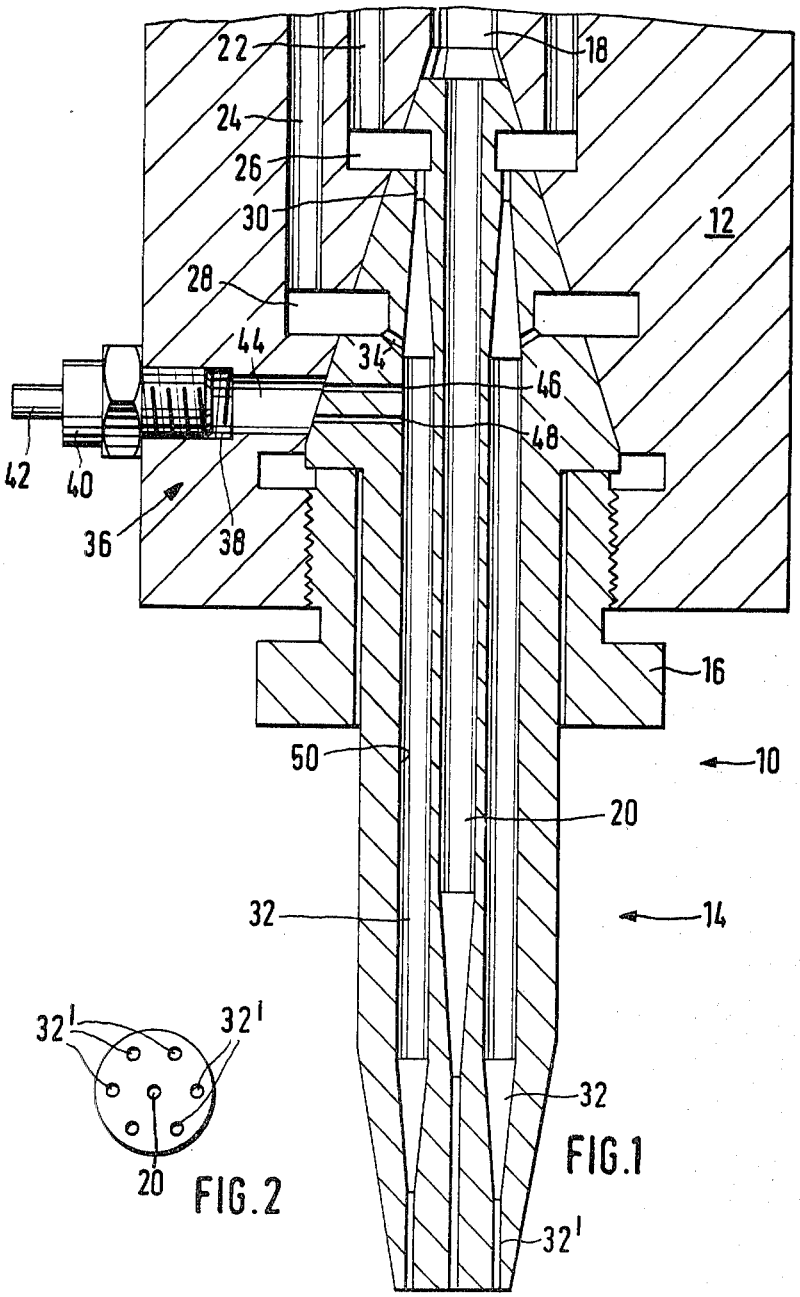

As shown in FIG. 1, a flame cutter 10 is represented which consists, in known fashion of a torch head 12 and a cutting nozzle 14 taken up by it. The cutting nozzle 14 is thereby held in a gas-tight manner, in the corresponding recess of the torch head 12 by means of an adjusting screw 16.

As can readily be seen, a cutting oxygen canal 18, which is connected with the appropriate canal or passage 20 in the cutting nozzle 14, is provided.

The heating oxygen passage and the fuel gas passage, 22 and 24 respectively, which are additionally provided in the torch head 12 discharge into the corresponding annular spaces 26, 28. These annular spaces are formed by appropriate recesses in the torch head 12 and by the graded upper region of the cutting nozzle 14 as can be seen in FIG. 1.

From the annular space 26, the heating oxygen arrives, via the bores 30, in the individual blend passages 32 which are arranged in a concentric circle, at equal distances in the cutting nozzle around the cutting oxygen canal 20. Each of these passages 32 is connected, via a bore 34, with the annular space 28 from which the fuel gas can thereby flow into the individual blend passages and there mix with the heating oxygen to form an ignitable mixture.

In accordance with the invention, one of these blend passages 32 is connected with an ignition device 36. For this purpose, a threaded bore 38 into which a glow plug (or a spark plug) is screwed, is provided in the torch head 12. This glow plug is connected, via a line 42, with the electrical control device of the flame cutting machine which is not illustrated.

The threaded bore 38 narrows down to an ignition passage 44 which is still a component of the torch head 12.

One of the blend passages 32 is tapped, in the example of embodiment in its upper region, in other words, directly behind the mixing point of heating oxygen and fuel gas, by two ignition bores 46, 48 which make up the connection between the blend passage and the ignition passage 44.

Both ignition bores 46, 48 are preferrably arranged in one plane and at a distance from one another.

The section of the blend passage 32 into which the ignition bores discharge is greater in cross section that at the mixing point as well as at the outlet end of the passage and thereby forms a so-called expansion space 50.

When the flame cutter 10 is brought into operation, the heating oxygen and the fuel gas flow, via the annular spaces 26, 28 into the respective blend passages 32 and there, they form an ignitable mixture. The thereby resulting mixture is slowed down in the expansion space 50 and thus receives the opportunity for an additional intensive mixing.

After passing through the expansion space 50, the mixture arrives in the region of the blend passage which narrows again, whereby the rate of the flow of the mixture increases again.

Part of the mixture flowing through the expansion space 50 reaches the glow plug 40 by means of the ignition bores 46, 48 and the ignition passage 44. By igniting this plug, the mixture present in the ignition passage is thereby ignited. The thereby occurring "microexplosion" spreads from the ignition passage 44, at high pressure, into the expansion space 50. Thus occurs the ignition of the mixture which is present there. The ignition is propagated in all directions in the expansion space 50. When the "microexplosion" leaves the ignition bores 46, 48 and enters into the expansion space 50, there results in this region, for a short moment, a blend-free space. An expansion of the burning mixture in the direction of the annular spaces 26, 28 does not occur since the oncoming gas mixture has a greater rate of flow than the rate of combustion of the gas mixture.

Regardless of this, however, the gas mixture would extinguish at the latest, when it reaches the annular spaces 26, 28 since then, the second component required for the combustion, namely the heating oxygen or the fuel gas, is missing.

Since the backward (in the direction of the annular spaces 26, 28) spreading of the ignition flame in the expansion space 50 is avoided, these (gases) exit as a flame from the corresponding blend passage 32 of the cutting nozzle. Because of the brief lack of gas mixture upon ignition in the expansion space, the flame which has come out of the passage 32 extinguishes again. Before this flame extinguishes, however, it has ignited the gas jets flowing out of the other blend passages 32 so that a circular heating flame concentrically surrounding the cutting oxygen passage 20 is formed.

As mentioned before, after the flame left the blend passage 32, it was extinguished on account of the resulting lack of gas mixture after ignition of the remaining gas jets flowing from the passages 32. In the meantime, an ignitable mixture which flows out of the passage 32 and which is in turn ignited by the other neighboring heating flames is formed in this ignition passage 32.

The above-mentioned inventive ignition device described by means of a flame cutter is also especially advantageously suited for the ignition of scarfing torches regardless of whether one deals with a rotary scarfing torch or a broad range scarfing torch. As a result of this inventive ignition device, a continually certain ignition of the gas mixture is obtained in an advantageous manner without the necessity for expensive measures.

What is claimed is:

1. A gas-mixture flame cutter comprising a cutting torch having a torch head, a cutting nozzle detachably engaged to said torch head, said cutting nozzle having an upstream end and a downstream end, a cutting oxygen channel extending through said torch head and through said cutting nozzle and terminating at said downstream end of said cutting nozzle, a plurality of spaced combustible mixture blend passages in said cutting nozzle and terminating at said downstream end of said cutting nozzle adjacent said cutting oxygen channel whereby said cutting oxygen channel and said blend passages are exposed at said downstream end of said cutting nozzle, heating oxygen passage means in said torch head communicating with said blend passages for supplying heating oxygen to said blend passages, fuel gas passage means in said torch head communicating with said blend passages for supplying fuel gas to said blend passages, one of said blend passages being an ignition blend passage, an ignition device being in flow communication with said ignition blend passage at said upstream end of said cutting nozzle, and the remaining blend passages being out of flow communication with said ignition device whereby actuation of said ignition device causes the combustible mixture in said ignition blend passage to ignite and to be extinguished after igniting the combustible mixture exiting from said remaining blend passages with the ignited combustible mixture from said remaining blend passages then reigniting the combustible mixture from said ignition blend passage.

2. Flame cutter according to claim 1, characterized therein that said ignition device is located in said torch head and is connected with said blend passage via at least one ignition bore.

3. Flame cutter according to claim 2 characterized therein that said ignition device is a glow plug screwed into a threaded bore of said torch head.

4. Flame cutter according to claim 3, characterized therein that an ignition passage having a greater cross section than said ignition bore joins said ignition bore to said glow plug.

5. Flame cutter according to claim 4, characterized therein that a plurality of ignition bores are located between said ignition passage and said blend passage.

6. Flame cutter according to claim 5, characterized therein that said ignition bores are located in the same plane one above the other.

7. Flame cutter according to claim 6, characterized therein that said blend passage has an expansion space into which said ignition bores discharge.

8. Flame cutter according to claim 2, characterized therein that said blend passage has an expansion space into which said ignition bore discharges.

* * * * *